United States Patent [19]

Crosby

[11] 4,328,286

[45] May 4, 1982

[54] ELECTRODEPOSITED PALLADIUM, METHOD OF PREPARATION AND ELECTRICAL CONTACT MADE THEREBY

[75] Inventor: Jeffrey N. Crosby, Worcester, England

[73] Assignee: The International Nickel Co., Inc., New York, N.Y.

[21] Appl. No.: 137,386

[22] Filed: Apr. 4, 1980

[30] Foreign Application Priority Data

Apr. 26, 1979 [GB] United Kingdom ..... 14529/79

[51] Int. Cl.[3] ..... C25D 5/10; H01H 1/02

[52] U.S. Cl. ..... 428/636; 200/268; 204/40; 204/47; 428/670; 428/926; 428/929; 428/935

[58] Field of Search ..... 204/40, 41, 47; 200/268; 428/636, 670, 926, 929, 934, 935

[56] References Cited

U.S. PATENT DOCUMENTS

| | | | |
|---|---|---|---|
| 1,970,950 | 8/1934 | Wise | 204/47 |
| 3,150,065 | 9/1964 | Fatzer | 204/47 |
| 3,309,292 | 3/1967 | Andrews et al. | 204/39 |
| 3,500,537 | 3/1970 | Angus | 204/47 X |
| 3,544,435 | 12/1970 | Angus et al. | 204/47 |
| 3,920,526 | 11/1975 | Caricchio et al. | 204/47 |
| 4,076,599 | 2/1978 | Caricchio et al. | 204/47 |

FOREIGN PATENT DOCUMENTS

| | | |
|---|---|---|
| 2360834 | 6/1975 | Fed. Rep. of Germany . |
| 367588 | 2/1932 | United Kingdom . |
| 381932 | 10/1932 | United Kingdom . |
| 408244 | 4/1934 | United Kingdom . |

OTHER PUBLICATIONS

Chemical Abstracts, vol. 86, 48457g, (1977).
Chemical Abstracts, vol. 88, 29518c, (1978).
Chemical Abstracts, vol. 91, 46317r, (1979).
T. R. Shives et al., "The Role of Coatings in the Prevention of Mechanical Failures", NBS, pp. 64–71, (1976).
A. Keil et al., Electronic Production, pp. 64, 67, Feb. 1980.
L. Siaurukaite et al., Liet. TSR Moksul Akad. Darb., Ser. B., 61 (2), 39–45, (1970).
L. Siaurukaite et al., Leit. TSR Mokslu Akad. Darb., Ser. B., 65 (2), 49–59, (1971).
Chemical Abstracts, vol. 61, 295e, (1964).
Chemical Abstracts, vol. 62, 6219c, (1965).
Chemical Abstracts, vol. 72, 38153b, (1970).
Chemical Abstracts, vol. 83, 106745a, (1975).
John E. McCaskie, Plating in the Electronics Industry, 5th Symposium, AES, pp. 5–27, (1975).
A. J. Bard, "Encyclopedia of Electrochemistry of the Elements", vol. VI, pp. 265–266 & 274, (1976).
H. Grossman, Trans. Inst. Metal Finishing, vol. 56, pp. 54–56, (1978).
H. D. Hedrich et al., Surface Technology, vol. 8, pp. 347–362, (1979).
Metal Finishing, p. 82, Jun. 1978.
A. M. Yampolsky, Electroplating & Metal Finishing, pp. 76–78, Mar. 1963.
Johannes Fischer et al., "Precious Metal Plating", pp. 213–221, (1964).
J. M. Stevens, Trans. Inst. Metal Finishing, vol. 46, pp. 26–31, (1968).

*Primary Examiner*—G. L. Kaplan
*Attorney, Agent, or Firm*—Raymond J. Kenny; Miriam W. Leff

[57] ABSTRACT

The invention provides a method of electrodepositing palladium on a substrate e.g. an electrical switch contact, to give a coating having low transverse porosity and good slip wear resistance. The method involves electrodepositing a first layer from an alkaline bath containing a cationic palladium ammine complex and then electrodepositing on the first layer a second layer from an acid bath containing an anionic palladium nitrite complex.

32 Claims, No Drawings

ELECTRODEPOSITED PALLADIUM, METHOD OF PREPARATION AND ELECTRICAL CONTACT MADE THEREBY

This invention relates to the electrodeposition of palladium. More particularly, it concerns a method of producing an electrical contact or connector material comprising a duplex coating of electrodeposited palladium and articles produced by such method.

BACKGROUND OF THE INVENTION

Connectors or contacts used in electrical circuits must possess excellent resistance to oxidation and corrosion in addition to good electrical conductivity. Electrodeposits of gold on a suitable metallic substrate such as copper or copper alloys have commonly been used but more recently it has been proposed to use palladium to replace gold in view of its comparable electrical conductivity and oxidation/corrosion resistance and because it is relatively inexpensive. Other requirements of the deposited metal are firstly that it must have very low and preferably zero transverse porosity at economical thicknesses in order that problems associated with corrosion of the substrate are obviated, secondly that the metal is ductile so that it can withstand flexing in service without exposing the substrate and thirdly that the metal is wear-resistant so that repeated mating of the connectors does not expose the substrate.

A currently available palladium bath, which is described in U.S. Pat. No. 3,920,526, is being proposed for uses such as coating of connectors and comprises specified quantities of the compound $Pd(NH_3)_2Cl_2$ and ammonium chloride and sufficient aqueous ammonia to provide a pH of at least 8.8. However, it is common for both engaging parts of the connectors to be plated with the palladium and in such cases it has been found that the resistance to sliding wear is insufficient. A similar bath is reported in a book entitled "Precious Metal Plating" by Fischer and Weimer, published by Robert Draper Limited, Teddington, England. Fischer and Weimer also report on electrodepositing palladium from an acid bath prepared from palladium chloride, sodium nitrite, boric acid and sodium chloride. The nitrite bath contains the anionic complex $Pd(NO_2)_4^{2-}$. However, it has been found that palladium deposits from such baths have high transverse porosity and are therefore unsuitable as coatings for electrical contacts or connectors.

There is therefore a need for a method of producing palladium electrodeposits that possess adequate sliding wear resistance and adequately low transverse porosity in addition to possessing all the other properties referred to above.

We have now surprisingly found that this can generally be achieved by means of a duplex palladium electrodeposit formed from two specifically defined plating baths and that this duplex deposit retains its economical advantages over other non-duplex deposits because, surprisingly, the necessary thickness of each layer required in the duplex coating is generally considerably less than the minimum thickness necessary to obtain a desired property of the respective single layer coatings.

Hereinafter the term electrical contact material refers to electrical contacts, connectors, switches, printed circuit plates and the like or any part of such device.

INVENTION

In accordance with the invention there is provided a method of producing a palladium coating on a substrate, which method comprises electrodepositing a first layer of palladium from a first aqueous bath comprising a cationic palladium ammine complex and free ammonia, and then on the first palladium layer electrodepositing a second layer of palladium from a second aqueous bath comprising the anionic complex $Pd(NO_2)_4^{2-}$.

In accordance with one aspect of this invention a method is provided for producing an electrical contact material having high resistance to oxidation and corrosion and good electrical conductivity and the duplex coating produced by the foregoing method has low transverse porosity and good slip wear resistance.

PREFERRED EMBODIMENTS OF INVENTION

The first bath, i.e. the bath for the deposition of the first palladium layer, is necessarily alkaline in order to maintain the presence of the free ammonia and preferably the pH is at least about 8.8. Although such baths are operable at pH's higher than 10, the pH maximum preferably does not exceed 9.5 and is most preferably less than about 9.2, e.g. 9.0.

The first bath can readily be prepared by mixing in aqueous solution the ingredients, e.g. a palladium diammine complex, ammonia and supporting anions. Conveniently the bath contains at least about 12 g/l of the compound $Pd(NH_3)_2Cl_2$ (corresponding to a palladium concentration of at least about 6 g/l). Although this compound can be present in amounts up to its solubility limit there is no general practical advantage in exceeding about 36 g/l (corresponding to 18 g/l of palladium), because above this figure there tends to be significant losses of palladium by drag-out. Most preferably, the concentration of palladium in the first bath is from about 7 to 13 g/l. It is believed that the palladium diammine complex)$_2$ forms $Pd(NH_3)_4^{2+}$ in solution in the presence of sufficient ammonia to give free ammonia in solution and an alkaline pH.

Sufficient ammonia must be added to ensure that at least some free ammonia is present and that the bath pH is at the desired level.

The supporting anions, which may be one or more of $Cl^-$, $Br^-$, $OH^-$, $NH_2SO_3^-$, $NO_2^-$, $NO_3^-$, can be provided, e.g. by adding an additional amount of the appropriate ammonium salt, e.g. ammonium chloride. Amounts of $NH_4Cl$ up to about 250 g/l can be added and preferably the minimum content is about 5 g/l, most preferably about 15 g/l. No special properties result from the use of still higher ammonium chloride concentration.

Neither the current density nor the temperature is critical to the deposition of the first palladium layer but the current density is conveniently from about 0.2 to about 2 A/dm$^2$ and the temperature is preferably kept relatively low, e.g. from room temperature up to about 30° C., so as to avoid loss of excessive amounts of ammonia.

Turning to the second bath for the electrodeposition of the second palladium coating, this can readily made by preparing an aqueous solution containing Pd(II) chloride, preferably in an amount sufficient to provide a palladium concentration of from about 1 to about 10 g/l, e.g. 5 g/l, and sodium nitrite preferably from about 5 to about 30 g/l, e.g. 20 g/l. The bath also usefully contains sodium chloride as an additional electrolyte, preferably from about 30 to about 70 g/l, e.g. 50 g/l and boric acid, preferably from about 10 to about 50 g/l, e.g. 30 g/l. The supporting cations may be, for example, an alkali metal ion.

The pH temperature and current density are not too critical. Preferably the pH is from about 5.5 to about 6.5, e.g. 6.0, the temperature is preferably from about 15° to about 70° C., most preferably about 40° to about 60° C., e.g. 50° C. and the current density is conveniently from about 0.1 to about 2 A/dm$^2$.

In operation of the baths, any suitable insoluble anodes may be employed including those made of platinum or platinized titanium. Gentle agitation of the baths is preferred. Plating is usually performed in single compartment cells and the cathode (or substrate being plated) should clearly be made of a substance not attacked by the bath solution used for depositing the first palladium coating. Copper cathodes are especially suitable.

The success of the duplex coatings produced by the process of the invention has been convincingly demonstrated in practical tests in which wear characteristics generally at least as good as those of nickel-hardened gold deposits were exhibited together with low-porosity characteristics which were considerably better than those of similar thicknesses of single layer deposits produced from known baths.

A surprising aspect of the invention is that the required properties of the duplex deposit can generally be obtained using lower thicknesses of each of the component layers than would be predicted from tests on the individual component layers alone.

The thickness of the first layer should preferably not be much less than 1 μm since, below that thickness, the duplex coating tends to become porous irrespective of the thickness of the second layer. Furthermore, the second layer should preferably be greater than approximately 1.25 μm since, at lower thicknesses, the duplex coating tends to wear badly irrespective of the thickness of the first layer.

EXAMPLES

To exemplify the properties of deposits of the invention, tests were conducted in which palladium was deposited onto copper disc cathodes 2.54 cm in diameter (10 cm$^2$ total surface area) from a first and/or second bath containing a solution prepared and operated as follows:

Bath A

Amounts of the solid compound $Pd(NH_3)_2Cl_2$ and ammonium chloride were dissolved in aqueous solution with sufficient aqueous ammonia (30 wt. %) to provide a solution containing 12.5 g/l of palladium, 169 g/l of ammonium chloride and free ammonia. The pH of the solution was 9.0. Replenishment of the bath was effected during use of the bath to maintain these figures essentially constant. The cathode current density employed was 1 A/dm$^2$ and the temperature of the solution was 25° C.

Bath B

This was prepared by mixing sufficient Pd(II) chloride to provide 5 g/l of palladium with 20 g/l of sodium nitrite and also adding 50 g/l of sodium chloride and 30 g/l of boric acid. The pH of the solution was 6.0. Again replenishment of the bath was effected during use to maintain these figures essentially constant. The cathode current density was 1 A/dm$^2$ and the temperature of the solution was 50° C.

Results of the plating tests conducted using these baths are shown in the Table which also shows the results of a wear test and a porosity test on each deposit.

The wear tests were conducted to simulate sliding wear which occurs in use between the component parts of a variety of electrical connectors and were effected by reciprocating the plated copper discs in contact with a hemispherical end of a circular cross section rod of diameter 3.2 mm and also bearing a palladium electrodeposit identical to that on the copper disc, the rod being urged against a disc face by a load of 100 g. The duration of each test was fixed at 100 cycles of reciprocation. The width of the resulting wear track caused by the impingement of the rod on the plated copper disc face has been found to be a good measure of the sliding wear resistance of the deposit on the disc when in contact with a component bearing the same deposit.

The results in the Table show the improved wear resistance of the duplex deposits of the invention in contrast to the single layer deposits from Bath A.

Porosity measurements were made by the electrographic method with a commercial available instrument (Poroprint S, Fischer Instrumentation GB Ltd) using cadmium sulfide test papers with distilled water as electrolyte, anode current density of 7.5 mA/cm$^2$ for 30 seconds, and a pad pressure of 250 lbs./sq. inch (1.72 N/mm$^2$). Typical results of the porosity tests are reported in the Table as a count of the average number of pores visible on 1 cm$^2$ of surface area of the electrographic print.

The results in the Table show that the duplex coatings of the invention give satisfactorily low porosity counts at total thicknesses which are substantially below all thicknesses of single layer deposits giving comparably low porosity counts from Bath A.

TABLE

| Deposit | Type | Thickness of Deposit from Bath A (μm) | Thickness of Deposit from Bath B (μm) | Total Deposit Thickness (μm) | Wear Test Track Width (mm)* | Porosity (Pores/cm$^2$) |
|---|---|---|---|---|---|---|
| 1 | Single | 2.5 | — | 2.5 | 0.70 | ~15 |
| 2 | Single | 5.0 | — | 5.0 | 0.60 | 3 |
| 3 | Single | — | 3.0 | 3.0 | 0.20 | Cracked Deposit |
| 4 | Single | — | 2.0 | 2.0 | 0.20 | Cracked Deposit |
| 5 | Single | — | 1.5 | 1.5 | 0.70 | >100 |
| 6 | Single | — | 1.0 | 1.0 | 0.55 | >100 |
| 7 | Duplex | 1.0 | 2.0 | 3.0 | 0.15 | Zero |
| 8 | Duplex | 1.5 | 1.5 | 3.0 | 0.20 | 1 |
| 9 | Duplex | 1.25 | 1.25 | 2.5 | 0.20 | 1 |
| 10 | Duplex | 1.0 | 1.5 | 2.5 | 0.15 | 1 |
| 11 | Duplex | 2.0 | 1.0 | 3.0 | 0.50 | 2 |

*Wear track width obtained under similar test conditions for a 2.5 μm nickel-hardened gold deposit from a commercial plating bath is typically 0.20 mm.

In general, although the wear resistance of single deposits obtained from Bath B above a minimum critical thickness of about 2 μm are generally good, such deposits are highly porous at all thicknesses. Furthermore, although deposits obtained from Bath A approach zero porosity at thicknesses of about 4 to 5 μm the test results in the Table in respect of deposit 2 show that wear resistance is poor.

The duplex coatings of the invention on the other hand can provide both low porosity and good wear resistance at thicknesses of the individual component deposits less than the above minimum for the single deposits and at a total thickness lower than 6 μm and can generally be as low as 2.5 μm .

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method of producing an electrical contact material having high resistance to oxidation and corrosion and good electrical conductivity comprising a duplex coating of electroplated palladium on a substrate comprising electroplating on the substrate a first layer of palladium from a first aqueous bath having an alkaline pH and comprising a cationic palladium ammine complex and free ammonia, and then on the first layer of palladium electrodepositing a second layer of palladium from a second aqueous bath having an acid pH and comprising the anionic complex $Pd(NO_2)_4^{2-}$, whereby a duplex coating is produced having low transverse porosity and good slip wear resistance.

2. A method of producing an electrical contact material as claimed in claim 1, characterized in that the cationic palladium ammine complex is one resulting from the addition to water of $Pd(NH_3)_2Cl_2$ and sufficient ammonia to provide free ammonia in solution and an alkaline pH.

3. A method of producing an electrical contact material as claimed in claim 1, characterized in that the cationic palladium ammine complex is $Pd(NH_3)_4^{2+}$.

4. A method of producing an electrical contact material as claimed in claim 1, characterized in that the concentration of palladium in the first bath is at least about 6 g/l.

5. A method of producing an electrical contact material as claimed in claim 1, characterized in that the concentration of palladium in the first bath is in the range of from about 7 to about 13 g/l.

6. A method of producing an electrical contact material as claimed in claim 1, characterized in that the concentration of palladium in the second bath is in the range of from about 1 to about 10 g/l.

7. A method of producing an electrical contact material as claimed in claim 1, characterized in that the second bath contains sodium nitrite in an amount of from about 5 to about 30 g/l and sodium chloride in an amount from about 30 to about 70 g/l.

8. A method of producing an electrical contact material as claimed in claim 1, characterized in that the second bath includes boric acid in an amount from about 10 to about 50 g/l.

9. A method of producing an electrical contact material as claimed in claim 1, characterized in that the combined thickness of the first and second layers is less than about 6 μm.

10. A method of producing an electrical contact material as claimed in claim 9, characterized in that the first layer has a thickness of at least about 1 μm and the second layer has a thickness greater than about 1.25 μm.

11. A method of producing an electrical contact material as claimed in claim 10, characterized in that the combined thickness of the first and second layers is at least about 2.5 μm.

12. An electrical contact material comprising a substrate and a duplex electroplated coating of palladium having low transverse porosity and good slip wear resistance produced from the method comprising electroplating on the substrate a first layer of palladium from a first aqueous bath having an alkaline pH and comprising a cationic palladium ammine complex and free ammonia, and then on the first layer of palladium electrodepositing a second layer of palladium from a second aqueous bath having an acid pH and comprising the anion complex $Pd(NO_2)_4^{2-}$.

13. An electrical contact material as claimed in claim 12, characterized in that the combined thickness of the first and second layers is less than about 6 μm.

14. An electrical contact material as claimed in claim 12, characterized in that the first layer has a thickness of at least about 1 μm and the second layer has a thickness greater than about 1.25 μm.

15. An electrical contact material as claimed in claim 12, characterized in that the combined thickness of the first and second layers is at least about 2.5 μm.

16. An electrical contact material as claimed in claim 12, characterized in that the cationic palladium ammine complex is one resulting from the addition to water of $Pd(NH_3)_2Cl_2$ and sufficient ammonia to provide free ammonia in solution and an alkaline pH.

17. An electrical contact material as claimed in claim 12, characterized in that the cationic palladium ammine complex is $Pd(NH_3)_4^{2+}$.

18. A method of producing a palladium coating on a substrate, which method comprises electrodepositing a first layer of palladium from a first aqueous bath having an alkaline pH and comprising a cationic palladium ammine complex and free ammonia, and then electrodepositing a second layer of palladium from a second aqueous bath having an acid pH and comprising the anionic complex $Pd(NO_2)_4^{2-}$.

19. A method of producing a palladium coating as claimed in claim 18, characterized in that the concentration of palladium in the first bath is at least 6 g/l.

20. A method of producing a palladium coating as claimed in claim 18, characterized in that the concentration of palladium in the first bath is in the range of from 7 to 13 g/l.

21. A method of producing a palladium coating as claimed in claim 18, characterized in that the concentration of palladium in the second bath is in the range of from 1 to 10 g/l.

22. A method of producing a palladium coating as claimed in claim 18, characterized in that the second bath contains sodium nitrite in an amount of from about 5 to about 30 g/l and sodium chloride in an amount from 30 to 70 g/l.

23. A method of producing a palladium coating as claimed in claim 18, characterized in that the second bath includes boric acid in an amount from 10 to 50 g/l.

24. A method of producing a palladium coating as claimed in claim 18, characterized in that the combined thickness of the first and second layers is less than 6 μm.

25. A method of producing a palladium coating as claimed in claim 18, characterized in that the first layer has a thickness of at least 1 μm and the second layer has a thickness greater than about 1.25 μm.

26. A method of producing a palladium coating as claimed in claim 18, characterized in that the combined thickness of the first and second layers is at least about 2.5 μm .

27. A method of producing a palladium coating as claimed in claim 18, characterized in that the cationic palladium ammine complex is one resulting from the addition to water of $Pd(NH_3)_2Cl_2$ and sufficient ammonia to provide free ammonia in solution and an alkaline pH.

28. A method of producing a palladium coating on a substrate as described in claim 18, characterized in that the cationic palladium ammonia complex is $Pd(NH_3)_4^{2+}$.

29. An object having a palladium coating produced by a method defined in claim 18.

30. A method of producing an electrical contact material having high resistance to oxidation and corrosion and good electrical conductivity comprising a duplex coating of electroplated palladium on a substrate comprising electroplating on the substrate a first layer of palladium from a first aqueous bath having a pH of at least about 8.8 and comprising a cationic palladium ammine complex and free ammonia, and then on the first layer of palladium electrodepositing a second layer of palladium from a second aqueous bath having a pH from about 5.5 to about 6.5 and comprising the anionic complex $Pd(NO_2)_4^{2-}$, whereby a duplex coating is produced having low transverse porosity and good slip wear resistance.

31. An electrical contact material comprising a substrate and a duplex electroplated coating of palladium having low transverse porosity and good slip wear resistance produced from the method comprising electroplating on the substrate a first layer of palladium from a first aqueous bath having a pH of at least about 8.8 and comprising a cationic palladium ammine complex and free ammonia, and then on the first layer of palladium electrodepositing a second layer of palladium from a second aqueous bath having a pH from about 5.5 to about 6.5 and comprising the anion complex $Pd(NO_2)_4^{2-}$.

32. A method of producing a palladium coating on a substrate, which method comprises electrodepositing a first layer of palladium from a first aqueous bath having a pH of at least about 8.8 and comprising a cationic palladium ammine complex and free ammonia, and then electrodepositing a second layer of palladium from a second aqueous bath having a pH of about 5.5 to about 6.5 and comprising the anionic complex $Pd(NO_2)_4^{2-}$.

* * * * *